US007335085B2

(12) United States Patent
Lyman

(10) Patent No.: US 7,335,085 B2
(45) Date of Patent: Feb. 26, 2008

(54) ENTERTAINMENT AND STRESS RELIEF DISK

(76) Inventor: Daniel F. Lyman, 415 N. River Rd., Manchester, NH (US) 03104

( * ) Notice: Subject to any disclaimer, the term of this patent is extended or adjusted under 35 U.S.C. 154(b) by 1341 days.

(21) Appl. No.: 09/417,428

(22) Filed: Oct. 13, 1999

(65) Prior Publication Data

US 2001/0018310 A1 Aug. 30, 2001

(51) Int. Cl.
*A63H 33/00* (2006.01)

(52) U.S. Cl. ..... 446/486; 428/64.1; 428/66.5; 446/46; 482/148

(58) Field of Classification Search ..... 446/415, 446/486, 71–76, 46; 24/703.1; 220/213; 215/270, 271; 482/83, 148; 4/255; 428/64.1, 428/66.5

See application file for complete search history.

(56) References Cited

U.S. PATENT DOCUMENTS 225,752 A * 3/1880 Griswold et al. ..... 222/189.07
398,679 A * 2/1889 White ..... 4/255.11
724,545 A 4/1903 Conklin
949,551 A 2/1910 Schliecker
1,026,256 A 5/1912 Ehrman
1,178,147 A * 4/1916 Gardner ..... 4/255
1,215,311 A * 2/1917 Miller ..... 2/68
2,235,313 A * 3/1941 Cleveland ..... 81/3.4
2,604,316 A * 7/1952 O'Brien et al. ..... 267/159
2,656,592 A * 10/1953 Cataldo et al. ..... 29/446
3,247,521 A * 4/1966 Owen ..... 2/68
3,414,186 A * 12/1968 Jorgensen et al. ..... 417/395
3,672,380 A * 6/1972 Schuster ..... 4/256
4,152,863 A * 5/1979 Kubiatowicz ..... 446/486
4,622,702 A * 11/1986 Allen ..... 4/255
4,697,989 A * 10/1987 Perlov et al. ..... 417/53
4,722,451 A * 2/1988 Conrad ..... 215/365
4,768,237 A * 9/1988 Torti ..... 4/255
D301,156 S 5/1989 Bullard
4,915,017 A * 4/1990 Perlov ..... 92/5 R
5,155,877 A * 10/1992 Reed ..... 4/255.11
5,334,079 A * 8/1994 Gentile et al. ..... 446/486
5,454,779 A * 10/1995 Lurie et al. ..... 601/43

FOREIGN PATENT DOCUMENTS

FR 2640886 A * 6/1990

* cited by examiner

*Primary Examiner*—John A. Ricci
(74) *Attorney, Agent, or Firm*—George W. Neuner; Edwards Angell Palmer & Dodge LLP

(57) ABSTRACT

A device is described that possesses an overall shape that comfortably fits into a user's hand, and in particular, can be manipulated by the fingers. The device is fabricated of a pliable material that readily can be manipulated by manual pressure, yet holds its equilibrium positions absent pressure. The device has convex/concave surfaces which can be inverted to provide two stable equilibrium positions. The surfaces of the device may have different textures, such as smooth and ridged. The material of the device can have various colors, and also may be phosphorescent. Floral, fruit, spice and other scents may be added to the material such that the scent emanates from the device as the user manipulates the device.

14 Claims, 1 Drawing Sheet

ENTERTAINMENT AND STRESS RELIEF DISK

BACKGROUND OF THE INVENTION

1. Field of the Invention

The present invention relates to a passive diversion device for entertainment and stress relief. In particular, the device has two surfaces separated by a small distance and is configured to provide two equilibrium positions, one having a convex shape and the other having a concave shape when viewed from the same direction. The largest average dimension of the surfaces is substantially greater than the thickness of the device. By applying finger pressure to a surfaces of the device, the surfaces invert from one equilibrium position to the other.

2. Background Art

Hand held devices for exercise, amusement and stress relief are known in the industry. There are types of hand-held amusement devices that emit sounds. For example, U.S. Pat. No. 724,545 describes a snapping button with a springing snapping leaf. After pushing the leaf, it automatically springs back up to its original position and it emits a snapping sound. U.S. Pat. No. 949,551 describes a somewhat similar device with a convex surface that, after pushing in on the surface, automatically snaps back to its convex position due to the tension of the material. A hole in the device controls the sound emitted by the device. U.S. Pat. No. 1,206,933 describes a stiff plate with a reversible bulge, having a picture on its face, whereby reversal of the bulge causes the plate to emit a sound related to the picture. U.S. Pat. No. 1,026,256 describes a sounding disk made up of a diaphragm secured to a holder. Spaces are left between the holder and diaphragm such that movement of the diaphragm is not obstructed, and a high volume of sound is produced.

There are also hand-held exercise devices that provide stress relief such as U.S. Pat. No. 5,830,109. Such devices are typically digital or spherical in shape and are fabricated with flexible cores. These devices rest comfortably in a user's hand and the user squeezes and/or kneads the device.

Inexpensive amusement devices that also are capable of relieving stress are desirable and continuously sought.

SUMMARY OF THE INVENTION

The present invention provides a simple, inexpensive device that can be used for passive entertainment and stress relief through manual manipulation of the device. The device may be manufactured with varying degrees of stiffness, sizes, texture, color and scent so that individuals may chose a device based on personal preferences. The device may additionally be adapted to change color and/or produce sound upon manipulation.

In accord with the invention, an amusement and stress relief device comprises a flexible material formed into a disk-like shape having two opposite surfaces, a center portion and a peripheral portion, wherein the center portion has a convex/concave shape relative to the peripheral portion, and wherein the device is stable in tow positions, a first stable position where a first surface is concave and a second surface is convex and a second stable position where the first surface is convex and the second surface is concave. Preferably, the center portion protrudes out of a plane containing the peripheral portion. The disk-like device preferably has a circular peripheral edge, but can be formed with any shape peripheral edge.

Devices of the invention can be of any color, contain surface images or patterns, contain surface textures, contain scents, change colors, or contain various combinations of such features.

DETAILED DESCRIPTION OF THE INVENTION

Figure 1:
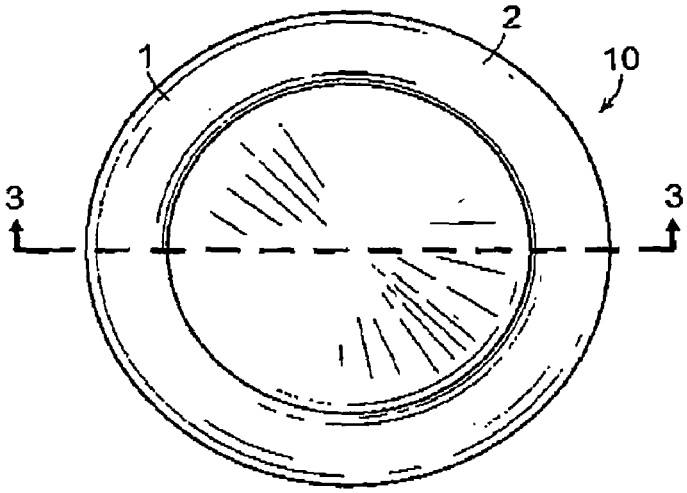
FIG. 1 is a top view of a preferred embodiment of the invention in the form of a disk.

With reference to the drawings, a preferred embodiment of the device in accord with the present invention will be described. The device 10 is shown in a preferred disk-like shape. However, the shape of the device may vary, for example, it may be square, octagonal, or triangular. Each device includes a peripheral lip portion 1 and a center portion 2 surrounded by the lip portion 1. The device has an upper surface 3 and a lower surface 4, one surface being concave and the other surface being convex. The concavity and convexity of the surfaces 3, 4 are interchangeable. In other words, the device has two stable equilibrium positions, one being the concave upper surface 3 with convex lower surface 4 and the other being the convex upper surface 3 with concave lower surface 4. Manual manipulation of the device inverts the surface from one equilibrium position to the other. The concave surface 3 or 4 preferably has a single peak 5 in the middle of the center portion 2. The device, however, may have more than one peak 5, provided that the two equilibrium positions as described are present in the device.

Figure 3:
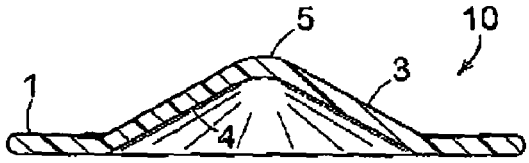
FIG. 3 is a cross sectional side view of the device of FIG. 1.

The cross-section of the device is substantially uniform in thickness. However, in a preferred device as shown in FIG. 3, the peripheral lip 1 is thicker in cross-section than the center portion 2. It is believed that the thicker peripheral portion can add stability to the equilibrium positions. The center portion 2 can be of uniform thickness or it can taper such that the thickness of the center portion 2 nearest the peripheral lip 1 is thickest and becomes thinner as it approaches the peak 5.

The dimensions of the device can vary depending upon both personal preference and the hand size of a user. Preferably, the disk has an overall diameter d (or length l of the longest dimension for non-circular shaped devices) ranging between about 0.75 inch and about 6 inches. The lip portion 1 forms a border around the center portion 2. The lip is sized such that the ratio of the width w of the lip to the diameter d is a maximum of about ¼. More preferably, w/d is in the range of about 1/30 to about 1/5. If the device is not circular, then the largest dimension of the device can be used as a pseudo diameter for considering the ratios discussed herein.

The thickness of the device depends upon a number of variables such as the diameter, the polymeric material being used to form the device including the flexibility of the material and its stiffness or hardness, the tactile response desired, etc. One skilled in the art can determine a suitable thickness by routine experimentation after fixing the other variables. Overall, the device has a substantially uniform cross-sectional thickness t, and the ratio of t/d typically is a maximum of about 1/10. More preferably, the ratio of t/d is in the range of about 1/80 to about 1/15. The thickness $t_c$ of the center portion 2 for a one inch diameter disk made of ethylene-vinyl acetate preferably is about 0.05 to 0.08 inch. However, the thickness can taper from the periphery of the disk to the center where it can be thinner, as previously discussed. Preferably, the peripheral lip 2 thickness $t_l$ is somewhat larger than the center portion 1 thickness $t_c$. The thickness of the peripheral lip portion is determined by appearance, tactile feeling and its affect on the stability of the equilibrium positions of the device. The thickness of the lip can be outside of the range of ratios discussed above, as long as the device exhibits the two equilibrium positions.

Figure 2:
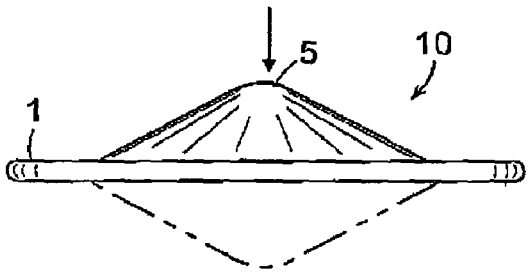
FIG. 2 is a side view of the device of FIG. 1 illustrating one equilibrium position and illustrating the second equilibrium position by dashed lines.

The height $h_p$ of the peak(s) 5 above the peripheral lip 2 or the plane containing the peripheral edge of the device depends also upon such variables as the desired appearance, the diameter and thickness of the device, the desired tactile response, the material from which it is formed, the desired life, etc. Such height can readily be determined by a routine experimentation after fixing the other variables. As illustrated in FIGS. 2 and 3, the ratio of $h_p/d$ preferably is a maximum of about 1/3. More preferably, the ratio of $h_p/d$ ranges between about 1/5 and about 1/10.

In one preferred embodiment, the device is disk shaped made of ethylene-vinyl acetate copolymer and has an overall diameter of about 1.0 to 1.5 inches, a peripheral lip width of about 0.2 inch, a cross sectional thickness at the lip portion 1 $t_l$ of about 0.030 inch, a cross sectional thickness at the center portion 2 $t_c$ of about 0.013 to 0.018 inch, and a peak height $h_p$ of about 0.12 to 0.18 inch. Even more preferably, the cross sectional thickness at the center portion 2 tapers from near the lip 1 inwards to the center such that the thickness near the lip 1 is about 0.030 inch and gradually decreases to a thickness $t_c$ at the center of about 0.015 inch.

Other diameter disks preferably are formed having similar ratios of dimensions.

The device can be formed in the shape of a square, triangle, octagon and many other shapes. The dimensions of the device for such shapes are similar to a disk of approximately the same surface size. In such other shapes, the length "l" of the longest dimension is equivalent to the disk diameter d, and the thickness, peripheral lip width and height are dimensioned accordingly, as discussed above.

The entire device can formed from a sheet of a thin, flexible material. Thus, after forming the bi-stable device, an individual can invert the top and bottom surfaces 3, 4 by manual manipulation. Preferably, the device is fabricated of a light, inexpensive polymeric material that is capable of independently retaining its shape at each of the two equilibrium positions. Various materials can be used to provide diverse degrees of stiffness so that individuals have options in choosing the amount of pressure that must be applied to invert the device surfaces 3, 4. The surfaces 3, 4 of the device also can be provided with various textures, such as smooth, ridged, bumpy, etc., each texture providing a different tactile affect when manually manipulated. The device may also be fabricated to emit sounds upon inverting the surfaces 3, 4 between their convex and concave positions. Generally, such noise making is accomplished by choosing particular device materials that are stiffer to produce a popping or snapping sound when they are inverted. The devices also can be made in varying colors, including pearlescent or iridescent materials, or can incorporate glow in-the-dark materials. Logos, characitures, initials, photographs and other illustrations also can be painted or embossed on the device surfaces 3, 4. Scented compositions can be contained in the device material, so as to emit a scent when the device is manipulated. The material also can be heat sensitive, for example, so as to change color as it is manipulated.

Figure 4:
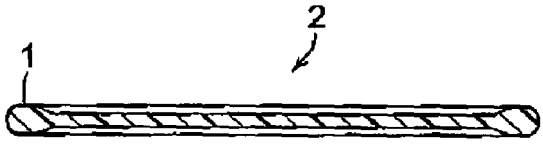
PRIOR ART FIG. 4
FIG. 4 is a cross sectional side view of a flexible, polymeric disk, which can be used to form the device illustrated in FIG. 1.

The device can be fabricated from the flexible seal found within the cap of certain bottles, such as certain plastic soda bottles. If one opens certain soda bottles, at the interior surface of the cap can be found a disk seal that is a separate component from the cap. This disk seal is typically flat and disk-shaped, with a lip portion 1 and a center portion 2 (see FIG. 4). The lip portion 1 typically has a cross-sectional thickness greater than that of the center portion 2, and the center portion 2 typically has a substantially uniform thickness as shown in FIG. 4. The exact dimensions of the seal will vary depending upon cap size and bottle type. This disk seal can be formed into a device in accord with the present invention having a bi-stable convex/concave shape by, for example, placing the center portion 2 over the tip of a hard curved surface of appropriate dimension, and pulling on the disk seal at the lip portion 1 until a peak 5 is formed at the center having the desired peak height $h_p$. When the device is formed as such, the center portion 2, which was initially uniform in thickness t, stretches out and becomes thinner and tapered in cross section from the lip portion 1 towards the peak(s) 5.

The disk seals found in certain bottle caps are typically formed of a material known as "Compound E04", which is manufactured by Crown Cork and Seal. The material is flexible, resilient, tough and translucent. "Compound E04" is a polymer made of 18% vinyl acetate copolymer of polyethylene. The material has a tensile strength of 2700 psi, an elongation of 700% and a flexural modulus of 8000 psi.

Any polymeric material having similar properties can be used to manufacture the device beginning. Such materials must have physical characteristics that permit forming a central peak and must be capable of inverting between and retaining opposing concave and convex positions at the peak. When the device having peak(s) 5 are manufactured as described above, by placing a flat polymeric disk over a rounded surface member and exerting force to stretch the device, polymers that have a tensile strength of at least 800 psi, an elongation of at least 100% and a flexural modulus of at least 200 psi are preferred. The properties of the polymer are determined to prevent the device from breaking or splitting during the fabrication process and to provide a device having the bi-stable positions for use.

Some specific examples of polymers that are suitable for the purposes of this invention are those exhibiting the above described characteristics and are described in the MODERN PLASTICS ENCYCLOPEDIA HANDBOOK (published by McGraw-Hill, Inc., 1994), for example: fluoroplastics (such as polymers and copolymers of florinated ethylene and polypropylene); polyamides or nylons; polybutylenes; thermoplastic polyesters (such as polyethylene terephthalate "PET"); polyethylene and ethylene copolymers (such as ethylene-ethyl acrylate "EEA", ethylene-methacrylate "EMA", ethylene-vinyl acetate "EVA", ethylene butyl acrylate "EBA", ionomers, ethylene-vinyl alcohol copolymers "EVOH", and ethylene acid copolymers); silicones; thermoplastic elastomers (such as polyolefin blends, thermoplastic copolyesters, and thermoplastic polyurethanes); vinyl polymers and copolymers; and blends thereof.

Alternatively, devices of the present invention can be formed from sheets of the polymer material by stamping the initial shape from a sheet to form a blank, and then forming the concave/convex portion by pulling the blank over a rounded surface. Another alternative is to form a plurality of concave/convex portions by vacuum forming the sheet, and then stamp out devices, each containing a concave/convex portion. Various textures can be formed onto the surface of the sheet by pressure and/or heated rollers or plates. Thus, the surfaces can be dimpled, contain ridges, or have other physical characteristics to provide a texture.

Another method for making the devices of the present invention uses molds for forming and shaping the device in one step by an injection molding process. Those skilled in the art easily may envision further alternative methods for making the devices of the present invention.

In addition to the use of colored polymeric materials, the surfaces 3, 4 can also be painted in varying colors, and logos, caricatures, initials, photographs and other illustrations can be painted or embossed on the surfaces 3, 4. The device can also incorporate chemicals to change colors with changes in temperature or other atmospheric conditions.

The invention including preferred embodiments thereof has been described herein. Such description is for illustrative purposes only, and it is to be understood that changes and variations may be made without departing from the spirit or scope of the invention as set forth in the following claims.

I claim:

1. A handheld amusement and stress relief device formed of a flexible, resilient polymeric material consisting essential of:

a center portion with a substantially planar peripheral portion surrounding the center portion;

the center portion having a concave first lower surface and a convex first upper surface, the device having two stable equilibrium positions whereby manual manipulation of the device inverts the surfaces between the two stable equilibrium positions, wherein a first stable equilibrium position comprises the first lower surface having a concave shape and the first upper surface having a convex shape and, after inversion, a second stable equilibrium position comprises the first upper surface now having a concave shape and the first lower surface now having a convex shape, wherein the second equilibrium position provides a shape that is substantially the same as the shape of the device in the first equilibrium position and the device will hold the second equilibrium position until manual manipulation returns the device to the first equilibrium position, wherein the thickness t of the center portion is tapered, such that a thickness $t_l$ near the peripheral portion is greater than a thickness $t_c$ near the center.

2. The device of claim 1, wherein the peripheral portion comprises a lip having a width w wherein the ratio of w to d is not greater than about ¼.

3. The device of claim 2, wherein the ratio of w to d is in the range of about 1/30 to about ⅕.

4. The device of claim 1, wherein the ratio of t to d is in the range of about 1/80 to about 1/20.

5. The device of claim 1, wherein a domed peak is formed in the center portion the peak having a height $h_p$ relative to a plane containing the peripheral portion, and the ratio of $h_p$ to d is not greater than about ⅓.

6. The device of claim 1, wherein the polymeric material is an ethylene-vinyl acetate polymer.

7. The device of claim 1, wherein at least one surface comprises an illustration.

8. The device of claim 1, wherein the material comprises a scent that is emitted from the device upon manual manipulation.

9. The device of claim 1, wherein the material comprises a composition that changes the color of the device upon changes in temperature or changes in other environmental conditions.

10. The device of claim 1, wherein the polymeric material is selected from the group consisting of fluoroplastics, polyamides, polybutylenes, thermoplastic polyesters, polyethylene and ethylene copolymers, silicones, thermoplastic elastomers, vinyl polymers and copolymers, and blends thereof.

11. The device of claim 1, wherein the material is a colored resin.

12. A handheld amusement and stress relief device formed of a flexible, resilient polymeric material consisting essentially of:

a center portion with a substantially planar peripheral portion surrounding the center portion;

the center portion having a concave first lower surface and a convex first upper surface;

the device having two stable equilibrium positions whereby manual manipulation of the device inverts the surfaces between the two stable equilibrium positions, wherein a first stable equilibrium position comprises the first lower surface having a concave shape and the first upper surface having a convex shape and, after inversion, a second stable equilibrium position comprises the first upper surface now having a concave shape and the first lower surface now having a convex shape, wherein the second equilibrium position provides a shape that is substantially the same as the shape of the device in the first equilibrium position and the device will hold the second equilibrium position until manual manipulation returns the device to the first equilibrium position, wherein at least one of the first and second surfaces are textured.

13. The device of claim 12, wherein the texture is provided by ridges formed on the surface.

14. The device of claim 12, wherein the texture is provided by dimples formed on the surface.

* * * * *